US010643585B1

(12) United States Patent
Geeslin

(10) Patent No.: US 10,643,585 B1
(45) Date of Patent: May 5, 2020

(54) AUXILIARY DEVICE COUPLED TO A STRINGED INSTRUMENT

(71) Applicant: Phillip Geeslin, Weatherford, TX (US)

(72) Inventor: Phillip Geeslin, Weatherford, TX (US)

( * ) Notice: Subject to any disclaimer, the term of this patent is extended or adjusted under 35 U.S.C. 154(b) by 33 days.

(21) Appl. No.: 16/193,744

(22) Filed: Nov. 16, 2018

(51) Int. Cl.
*G10D 3/08* (2020.01)

(52) U.S. Cl.
CPC ..... *G10D 3/08* (2013.01)

(58) Field of Classification Search
CPC ..... G10D 3/08
See application file for complete search history.

(56) References Cited

U.S. PATENT DOCUMENTS 738,018 A * 9/1903 Farago et al. ..... G10D 3/08 84/317
804,553 A * 11/1905 Sauer ..... G10D 3/08 84/317
1,374,388 A * 4/1921 Reed ..... G10D 3/08 84/315
2,429,138 A * 10/1947 Ruf ..... G10D 3/04 84/315
3,154,994 A * 11/1964 Blohm ..... G10D 3/08 84/317
3,623,390 A * 11/1971 Pitt ..... G10D 3/00 84/294
4,228,718 A * 10/1980 Smith ..... G10D 3/08 84/317
4,331,059 A 5/1982 Marabotto
7,307,203 B2 * 12/2007 Buffkin ..... G10D 3/08 84/286
7,812,233 B1 * 10/2010 Lee ..... G10D 3/08 84/317
8,319,082 B1 * 11/2012 Bacon ..... G10D 3/08 84/314 R
8,546,673 B2 * 10/2013 Peil ..... G10D 3/08 84/453
8,835,731 B1 9/2014 Perry
9,653,047 B2 5/2017 Chen
10,140,885 B1 * 11/2018 Norquest ..... G09B 15/026
2019/0311698 A1 * 10/2019 Douglas ..... G10D 3/08

* cited by examiner

*Primary Examiner* — Robert W Horn
(74) *Attorney, Agent, or Firm* — Sanchelima & Associates, P.A.; Christian Sanchelima; Jesus Sanchelima

(57) ABSTRACT

An auxiliary device coupled to a stringed instrument for producing chords is disclosed. The auxiliary device comprises a housing. The housing comprises a plurality of buttons and a plurality of actuators coupled to the plurality of buttons. Further, the auxiliary device comprises a rim coupled to the housing. In order to couple the auxiliary device to the stringed instrument, a neck of the stringed instrument is placed between the housing and the rim, such that the plurality of actuators are made to come in contact with stings of the stringed instrument. The plurality of buttons is pressed to operate the plurality of actuators. When operated, the plurality of actuators is made to depress to strum the strings to produce a chord.

13 Claims, 5 Drawing Sheets

AUXILIARY DEVICE COUPLED TO A STRINGED INSTRUMENT

BACKGROUND OF THE INVENTION

1. Field of the Invention

The present invention generally relates to a field of stringed instruments. More specifically, the present invention relates to an auxiliary device removably coupled to a stringed instrument such as a guitar, in which the auxiliary device is used to play the stringed instrument with little or no ability or proficiency.

2. Description of the Related Art

It is known that many people desire to learn to play a stringed instrument. The stringed instrument may include, but not limited to, an acoustic guitar, an electric guitar, a bass, a banjo, a mandolin and so on. Among the available stringed instruments, the guitar is an easily accessible and mostly used stringed instrument. However, it takes considerable time and effort to learn, understand and master the produce chords on the guitar.

Although it is difficult to learn and master playing the stringed instrument such as the guitar, it is possible to master producing chords with practice. However, people face few issues while operating the stringed instrument. For instance, fingers of a user may start to pain if the stringed instrument is operated for a long time. Further, the user may injure his finger while operating the stings to produce chords. Further, it is particularly difficult for people with disability or impaired in their hand(s) to play the stringed instruments.

Several devices have been disclosed in the past, which can be coupled to the stringed instrument for playing chords on the stringed instrument. One such example is disclosed in a U.S. Pat. No. 3,331,059. In U.S. Pat. No. 4,331,059A, an accompanying device for attachment to the neck of a string instrument, such as a guitar, for assisting in the playing of the selected chords to conform to a complete tone or melody is disclosed. The device comprises a container and a group of selector keys contained therein which are spaced at operational heights above the strings. Each selector has a number of elongations to reach the strings and engage them at the corresponding frets.

Another example is disclosed in a U.S. Pat. No. 7,812,233. In U.S. Pat. No. 7,812,233B1, an aiding device, "E-Z Master Chord", for playing fretted string instruments, such as an acoustic guitar played by a beginner, is provided. The aiding device according to the current application is engaged over frets of an acoustic guitar to generate a chord with only two fingers of a player.

Another example is disclosed in a U.S. Pat. No. 8,835,731. In U.S. Pat. No. 8,835,731B1, a removable chord playing attachment and related method is disclosed. The chord playing attachment may be attached to a guitar or similar stringed instrument, and the user may use the chord playing attachment to learn to play the instrument. The present invention discloses a design that does not function as a capo, which allows the user play chords in standard keys. The present invention encourages novices to learn to play the instrument in stages and eventually remove the invention entirely.

Another example is disclosed in a U.S. Pat. No. 9,653,047. In U.S. Pat. No. 9,653,047B2, a finger-pressed auxiliary device for a stringed instrument is provided. The stringed instrument comprises a body, a neck connected to the body, a fingerboard disposed on the neck, a plurality of frets disposed on the fingerboard at spaced intervals, and a plurality of strings extending along the length direction of the neck. The finger-pressed auxiliary device comprises: a plurality of finger-pressed plates extending along the length direction of the strings and each being disposed to correspond to a respective string; an upper support secured to the top of the neck; and a lower support secured to the bottom of the neck or the body. As the fingers only have to contact the surfaces of the finger-pressed plates, the pain associated with holding strings with fingertips is avoided.

Although the devices discussed above are helpful in aiding the user to produce chords, they have few problems. For instance, they are cumbersome, complex, and unclear. Further, it takes considerable time and effort to attach them to the stringed instrument.

Other documents describing the closest subject matter provide for a number of more or less complicated features that fail to solve the problem in an efficient and economical way. None of these patents suggest the novel features of the present invention. Specifically, none of the disclosures in the art disclose an auxiliary device removably coupled to stringed instrument, in which the auxiliary device is used to play the stringed instrument with little or no ability or proficiency.

Therefore, there is a need in the art for an auxiliary device coupled to a stringed instrument for producing chords.

SUMMARY OF THE INVENTION

It is one of the main objects of the present invention to provide an auxiliary device coupled to a stringed instrument for producing chords and that avoids the drawbacks of the prior art.

It is one object of the present invention to provide an auxiliary device comprising buttons coupled to actuators to strum the strings to produce a chord.

It is one object of the present invention to provide an auxiliary device coupled to a stringed instrument for producing chords. The auxiliary device comprises a housing. The housing comprises a plurality of buttons and a plurality of actuators coupled to the plurality of buttons. Further, the auxiliary device comprises a rim coupled to the housing. In order to couple the auxiliary device to the stringed instrument, a neck of the stringed instrument is placed between the housing and the rim such that the plurality of actuators are made to come in contact with stings of the stringed instrument. The plurality of buttons is pressed to operate the plurality of actuators. When operated, the plurality of actuators is made to depress to strum the strings to produce a chord.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

The following detailed description is intended to provide example implementations to one of ordinary skill in the art, and is not intended to limit the invention to the explicit disclosure, as one or ordinary skill in the art will understand that variations can be substituted that are within the scope of the invention as described.

The present disclosure discloses an auxiliary device coupled to a stringed instrument for producing chords. The auxiliary device comprises a housing. The housing comprises a plurality of buttons and a plurality of actuators coupled to the plurality of buttons. Further, the auxiliary device comprises a rim coupled to the housing. In order to couple the auxiliary device to the stringed instrument, a neck of the stringed instrument is placed between the housing and the rim, such that the plurality of actuators are made to come in contact with stings of the stringed instrument. The plurality of buttons is pressed to operate the plurality of actuators. When operated, the plurality of actuators is made to depress to strum the strings to produce a chord.

Various features and embodiments of an auxiliary device coupled to a stringed instrument for producing chords are explained in conjunction with the description of FIGS. 1-5.

Figure 1:
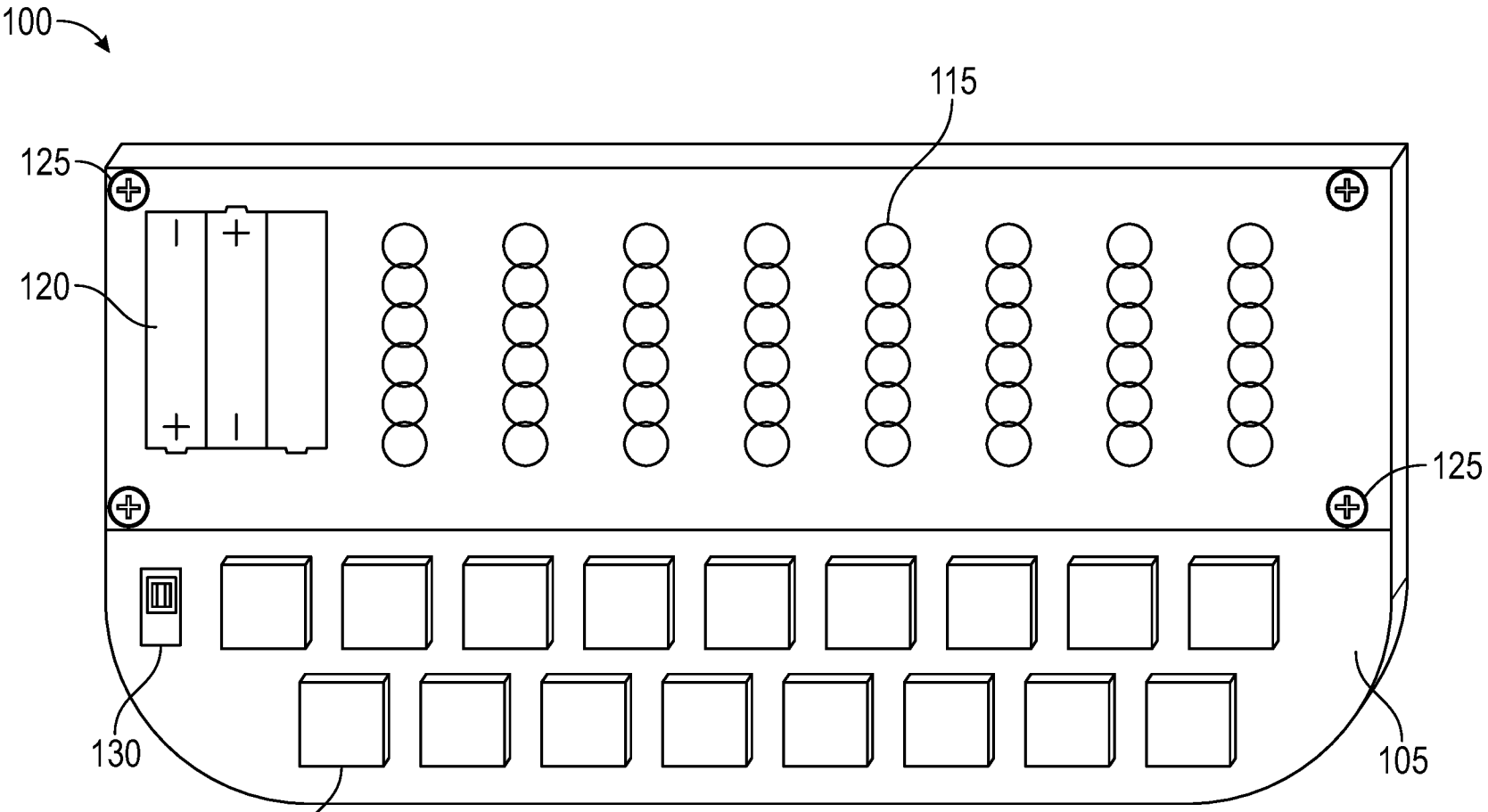
FIG. 1 illustrates a top view of an auxiliary device 100, in accordance with one embodiment of the present disclosure.

Referring to FIG. 1, a top view of an auxiliary device 100 is shown, in accordance with one embodiment of the present disclosure. The auxiliary device 100 comprises a housing 105. The housing 105 may be made up of suitable materials such as metal, wood and preferably plastic. The housing 105 may be provided in a square, rectangular, circular or any other shape. The housing 105 comprises a plurality of buttons 110. The plurality of buttons 110 may be provided in one or more rows in variety of shapes such as square, rectangular, circular and so on. In one example, one row of the plurality of buttons 110 may be provided in square shape and other row of plurality of buttons 110 may be provided in rectangular shape. Similarly, the plurality of buttons 110 may be provided in variety shapes and sizes to distinguish them based on size and shape.

Further, the housing 105 comprises a plurality of actuators 115. It should be understood that the plurality of actuators 115 are positioned such that the plurality of actuators 115 are made to come in alignment with strings when connected to a stringed instrument such as a guitar. As can be seen from FIG. 1, the plurality of actuators 115 are provided in a plurality of rows, each row comprising a set of actuators 115 which are aligned with respect to the strings. In one implementation, the plurality of actuators 115 is coupled to the plurality of buttons 110. In one example, the plurality of actuators 115 is coupled to the plurality of buttons 110 by means of cables or wires (not shown). It should be understood that pressing a button 110 engages an actuator 115 so that the actuator 115 is depressed. In other words, the actuator 115 is made to go down when the button 110 is pressed.

The auxiliary device 100 comprises batteries 120 at one side of the housing 105. The plurality of actuators 115 and the batteries 120 are secured in the housing 105 with the help of screws 125. Further, the housing 105 comprises a power ON/OFF button 130 used to activate and deactivate the auxiliary device 100.

Figure 2:
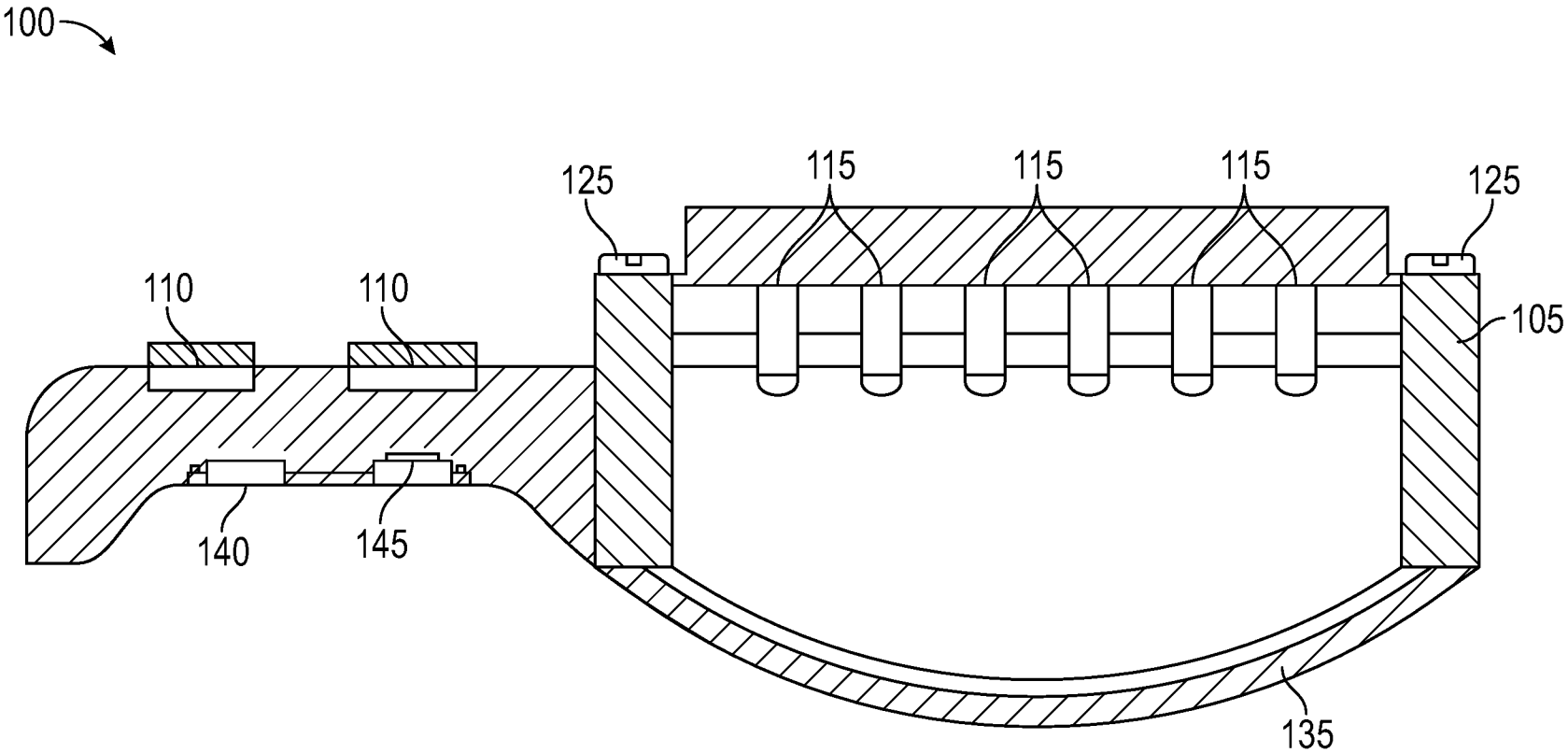
FIG. 2 illustrates a side view of auxiliary device 100, in accordance with one embodiment of the present disclosure.

Referring to FIG. 2, a side view of the auxiliary device 100 is shown, in accordance with one embodiment of the present disclosure. As can be seen, the housing 105 comprises a rim 135 provided in a semi-circular shape at bottom of the housing 105. The rim 135 may be used for receiving neck portion of the stringed instrument e.g., a guitar.

In one implementation, the auxiliary device 100 comprises a processor 140 and a memory 145. The memory 145 may be used to store program instructions and the processor 140 may be used to execute the program instructions stored in the memory 145.

Figure 3:
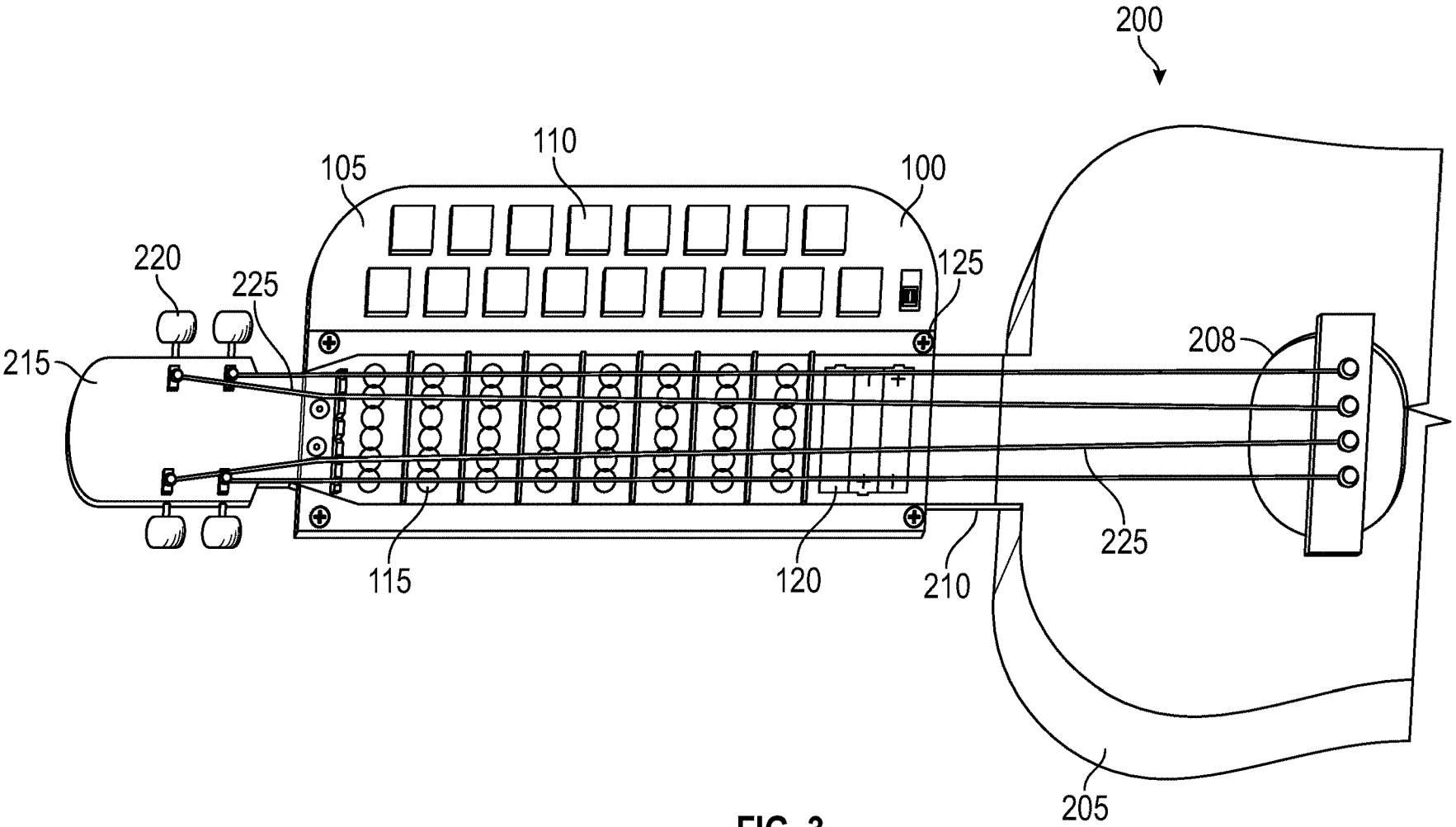
FIG. 3 illustrates a top view of the auxiliary device 100 coupled to a stringed instrument 200, in accordance with one embodiment of the present disclosure.
Figure 4:
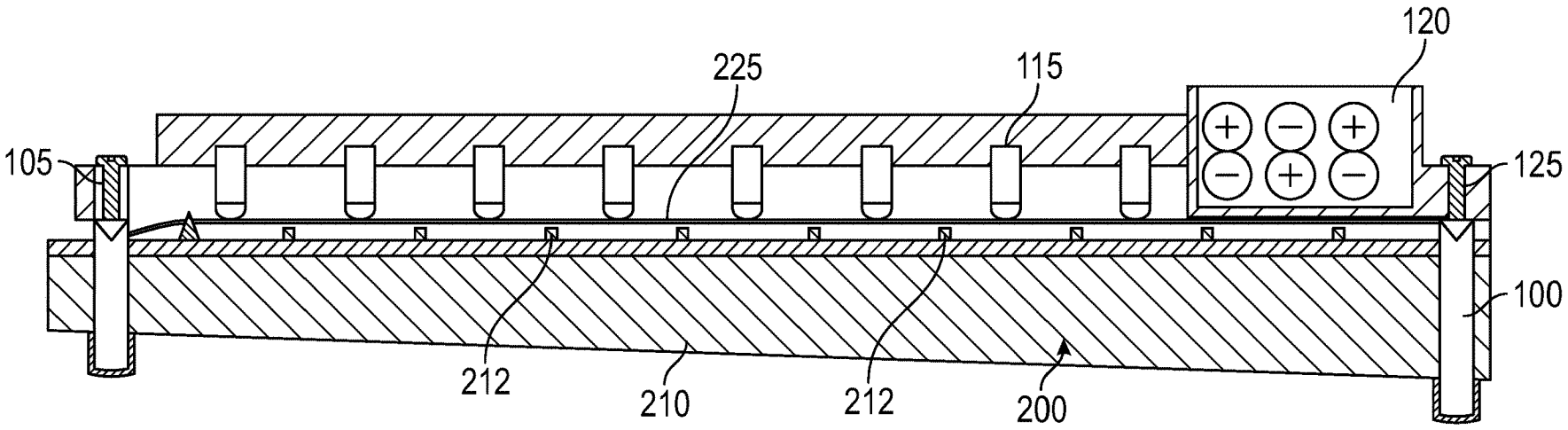
FIG. 4 illustrates a side view of the auxiliary device 100 coupled to the stringed instrument 200, in accordance with one embodiment of the present disclosure.
Figure 5:
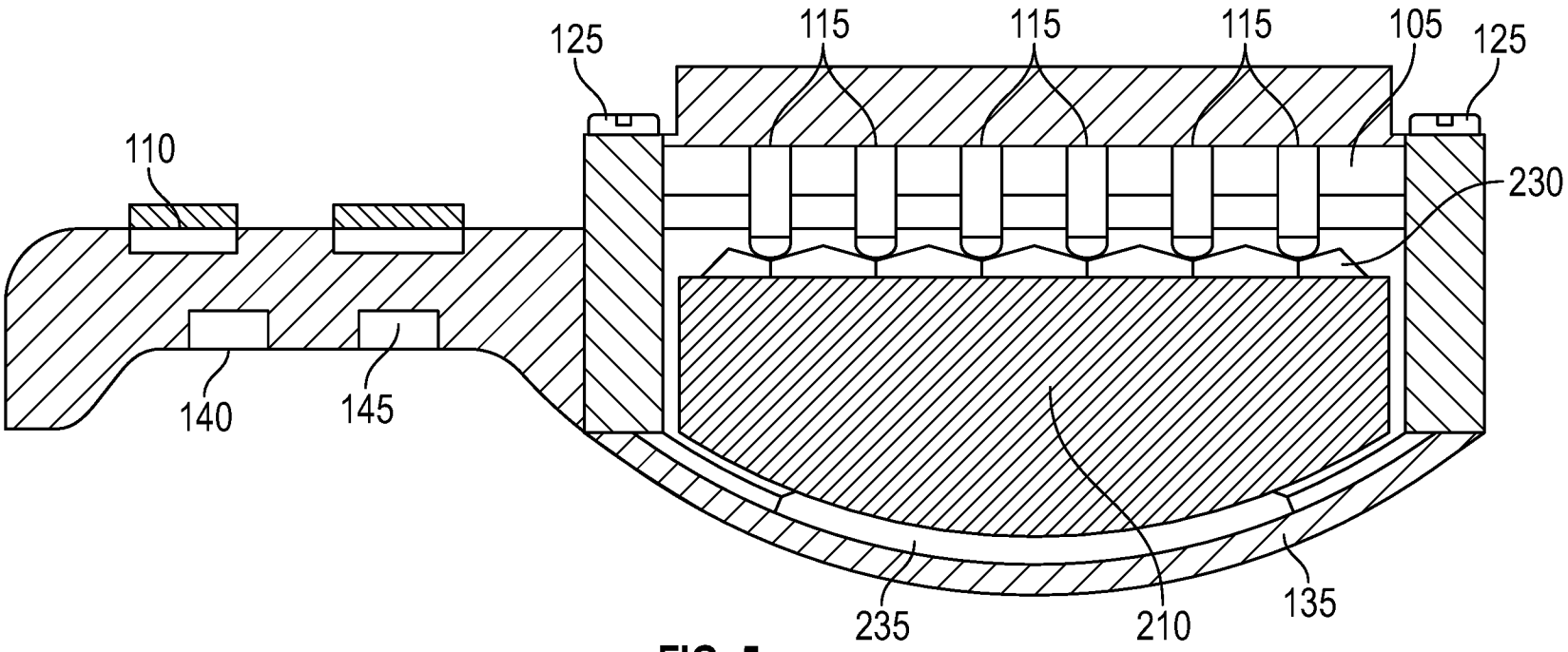
FIG. 5 illustrates a cross-sectional view of the auxiliary device 100 coupled to the stringed instrument 200, in accordance with one embodiment of the present disclosure.

Referring to FIGS. 3, 4 and 5, a top view, side view and a cross-sectional view of a stringed instrument 200 coupled to the auxiliary device 100, respectively is shown, in accordance with one embodiment of the present disclosure. The stringed instrument 200 may include, but not limited to, an acoustic guitar, an electric guitar, a bass, a banjo, a mandolin and so on. The present disclosure is explained considering that the stringed instrument 200 is a guitar, and that a person skilled in the art will understand that the auxiliary device 100 may also be coupled to other stringed instruments specified above to play the respective stringed instrument.

The stringed instrument 200 comprises a body 205. The body 205 comprises a sound hole 208. Further, the stringed instrument 200 comprises a neck 210. The neck 210 further comprises frets 212. The stringed instrument 200 comprises a head 215 provided with tuning pegs 220. Further, the stringed instrument 200 comprises strings 225. As known, the tuning pegs 220 may be used to tighten the strings 225. Further, the stringed instrument 200 comprises a bridge 230 to support the strings 225.

As can be seen, the auxiliary device 100 is coupled to the stringed instrument 200 by drawing the stringed instrument 200 through gap provided between the housing 105 and the rim 135 of the auxiliary device 100. Referring to FIG. 5, the cross-sectional view illustrates the stringed instrument 200 drawn through the auxiliary device 100. It should be understood that the rim 135 is shaped in such a way that the neck 210 is accommodated within the gap provided between the housing 105 and the rim 135 of the auxiliary device 100. In one example, a pad 235 made up of a soft material may be provided at the rim 135 such that the neck 210 is not damaged when coupled to the auxiliary device 100. After receiving the stringed instrument 200 into the auxiliary device 100, the screws 125 may be tightened to secure the auxiliary device 100 to the stringed instrument 200.

The auxiliary device 100 is coupled to the stringed instrument 200, in such a way that the strings 225 are aligned with the actuators 115 as shown in FIGS. 4 and 5.

In order to produce sound or chord on the stringed instrument 200, a user may press the button 110 provided on the housing 105. Upon pressing, the button 110 engages the actuator 115 and the actuator 115 is made to come in contact with the strings 225. In other words, the user may press the buttons 110 in a sequence to actuate the actuators 115, which in turn strum the strings 225 to produce chords. It should be understood that pressing each button 110 may produce a specific chord. As such, the user may press the buttons 110 in sequence to produce different chords.

In order to decouple the auxiliary device 100 from the stringed instrument 200, the screws 125 may be loosened or removed. Subsequently, the rim 135 is opened to remove the auxiliary device 100.

Based on the above description, it is evident that the auxiliary device may be used to produce chords with ease. In other words, depressing the buttons engages the actuators. The actuators in turn strum the strings to produce sound/chord. As such, a person without much knowledge about the stringed instrument may produce chords by simply pressing the buttons.

As such, children, beginners or people with disability in hands may use the auxiliary device to produce chords.

It should be understood that the shape and size of the auxiliary device illustrated in drawings is provided for illustrative purpose only and should not construed in limited sense. A person skilled in the art will appreciate various aspects described herein with modifications.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. An auxiliary device coupled to a stringed instrument, the auxiliary device comprising:

a housing including a plurality of buttons and a plurality of actuators coupled to the plurality of buttons, said plurality of buttons and said plurality of actuators being located on a top surface of said housing, said housing further defined by a buttons portion and an actuators portion, said buttons portion having rounded corners, said buttons portion being partially downwardly curving at a bottom side thereof that is ergonomic for ease of holding by a user during pressing of said plurality of buttons, said actuators portion having squared corners, said plurality of buttons arranged in columns, said plurality of actuators being arranged in rows, said buttons portion being adjacent to and lower than said actuators portion on said housing, said plurality of actuators extending downwardly therefrom said housing and being perpendicular to said housing, said plurality of actuators each including a rounded distal end; and a rim coupled to the housing, an instrument space is defined by the space therebetween said housing and said rim, wherein a neck of the stringed instrument is placed between the housing and the rim therein said instrument space to mount said auxiliary device to said stringed instrument, such that the plurality of actuators are made to come in contact with strings of the stringed instrument, wherein the plurality of buttons are pressed to operate the plurality of actuators, wherein the plurality of actuators are depressed to strum the strings to produce a chord, said plurality of buttons being away from said neck of said stringed instrument when said stringed instrument is therein said instrument space.

2. The auxiliary device of claim 1, wherein the auxiliary device comprises screws to secure the stringed instrument to the auxiliary device.

3. The auxiliary device of claim 1, further comprises batteries.

4. The auxiliary device of claim 1, further comprises a processor and a memory.

5. The auxiliary device of claim 1, wherein the auxiliary device comprises a pad at the rim to protect the neck of the stringed instrument.

6. The auxiliary device of claim 3, wherein said batteries being below and parallel to said rows of said plurality of actuators.

7. The auxiliary device of claim 4, wherein said processor and said memory being directly beneath said plurality of buttons on said housing.

8. The auxiliary device of claim 5, wherein said pad extends an entire length of said rim and is of a rounded shape that cooperates with the shape of said rim.

9. The auxiliary device of claim 1, wherein said housing includes a power ON/OFF button to activate and deactivate said auxiliary device.

10. The auxiliary device of claim 9, wherein said power ON/OFF button is mounted thereon said buttons portion adjacent to said plurality of buttons.

11. The auxiliary device of claim 1, wherein the number of said plurality of actuators per said rows corresponds with the number of said strings on said stringed instrument.

12. The auxiliary device of claim 2, wherein said screws separate said buttons portion and said actuators portion.

13. An auxiliary device coupled to a stringed instrument, the auxiliary device comprising:

a guitar having a body including a sound hole, a neck and shoulders, said string instrument being said guitar;

a housing including a plurality of buttons and a plurality of actuators coupled to the plurality of buttons, said plurality of buttons and said plurality of actuators being located on a top surface of said housing, said housing further defined by a buttons portion and an actuators portion, said buttons portion having rounded corners, said buttons portion being above one of said shoulders of said body of said guitar, said buttons portion being partially downwardly curving at a bottom side thereof that is ergonomic for ease of holding by a user during pressing of said plurality of buttons, said actuators portion having squared corners, said actuators portion being above said sound hole of said body of said guitar, said plurality of buttons arranged in columns, said plurality of actuators being arranged in rows, said buttons portion being adjacent to and lower than said actuators portion on said housing, said plurality of actuators extending downwardly therefrom said housing and being perpendicular to said housing, said plurality of actuators each including a rounded distal end; and a rim coupled to the housing, an instrument space is defined by the space therebetween said housing and said rim, wherein said neck of the guitar is placed between the housing and the rim therein said instrument space to mount said auxiliary device to said guitar, such that the plurality of actuators are made to come in contact with strings of the guitar, wherein the plurality of buttons are pressed to operate the plurality of actuators, wherein the plurality of actuators are depressed to strum the strings to produce a chord, said plurality of buttons being away from said neck of said guitar when said guitar is therein said instrument space.

* * * * *